US011958582B1

(12) United States Patent
Yasnoff

(10) Patent No.: US 11,958,582 B1
(45) Date of Patent: Apr. 16, 2024

(54) SYSTEMS, METHODS, AND APPARATUS FOR MARINE ENGINE STANDBY OPERATION

(71) Applicant: David Michael Yasnoff, Portland, OR (US)

(72) Inventor: David Michael Yasnoff, Portland, OR (US)

( * ) Notice: Subject to any disclaimer, the term of this patent is extended or adjusted under 35 U.S.C. 154(b) by 100 days.

(21) Appl. No.: 17/579,565

(22) Filed: Jan. 19, 2022

Related U.S. Application Data

(60) Provisional application No. 63/166,197, filed on Mar. 25, 2021, provisional application No. 63/205,947, filed on Jan. 19, 2021.

(51) Int. Cl.
*B63H 21/21* (2006.01)
*B63H 21/20* (2006.01)

(52) U.S. Cl.
CPC ..... *B63H 21/213* (2013.01); *B63H 21/20* (2013.01); *B63H 2021/202* (2013.01); *B63H 2021/216* (2013.01)

(58) Field of Classification Search
CPC ..... B63H 21/20; B63H 21/21; B63H 21/213; B63H 2021/216
See application file for complete search history.

(56) References Cited

U.S. PATENT DOCUMENTS

| | | | | |
|---|---|---|---|---|
| 5,222,901 | A * | 6/1993 | Burkenpas | B63H 21/213 440/86 |
| 10,920,732 | B1 * | 2/2021 | Ord | F02N 11/0818 |
| 2006/0081215 | A1 * | 4/2006 | Kinoshita | F02P 5/045 123/339.11 |
| 2006/0166573 | A1 * | 7/2006 | Vetta | B63H 20/12 440/75 |
| 2017/0356381 | A1 * | 12/2017 | Richards | F02D 41/3094 |
| 2020/0256263 | A1 * | 8/2020 | Rollinger | F02D 41/1454 |
| 2021/0309336 | A1 * | 10/2021 | Weismann | B63H 21/20 |

* cited by examiner

*Primary Examiner* — John Kwon

(57) ABSTRACT

A marine power system may include an engine arranged to provide mechanical output power for a boat, and a controller coupled to the engine, the controller configured to determine an idle condition of the boat, deactivate the engine based, at least in part, on the idle condition, determine a demand for the mechanical output power for the boat, and activate, using an auxiliary power source, the engine based, at least in part, on the demand. The controller may be configured to determine the demand based, at least in part, on a throttle control for the boat. The controller may be configured to determine the demand based, at least in part, on a position of a mechanical component of the throttle control. The controller may be configured to determine the demand based, at least in part, on a sensor on the throttle control.

20 Claims, 6 Drawing Sheets

SYSTEMS, METHODS, AND APPARATUS FOR MARINE ENGINE STANDBY OPERATION

CROSS-REFERENCE TO RELATED APPLICATIONS

This application claims priority from U.S. Provisional Patent Application Ser. No. 63/205,947 filed Jan. 19, 2021 which is incorporated by reference, and U.S. Provisional Patent Application Ser. No. 63/166,197 filed Mar. 25, 2021 which is incorporated by reference.

BACKGROUND

The inventive principles of this patent disclosure relate generally to marine engines, and more specifically to systems, methods, and apparatus for marine engine standby operation.

SUMMARY

A marine power system may include an engine arranged to provide mechanical output power for a boat, and a controller coupled to the engine, the controller configured to determine an idle condition of the boat, deactivate the engine based, at least in part, on the idle condition, determine a demand for the mechanical output power for the boat, and activate, using an auxiliary power source, the engine based, at least in part, on the demand. The controller may be configured to determine the demand based, at least in part, on a throttle control for the boat. The controller may be configured to determine the demand based, at least in part, on a position of a mechanical component of the throttle control. The controller may be configured to determine the demand based, at least in part, on a sensor on the throttle control. The controller may be configured to activate the engine based, at least in part, on an interlock scheme. The interlock scheme may include a second control. The second control may include a switch. The demand may be a first demand, and the controller may be configured to operate the engine at a first power level based, at least in part, on the first demand, determine a second demand for the mechanical output power, and operate the engine at a second power level based, at least in part, on the second demand. The controller may be configured to generate the second demand based, at least in part, on an interlock scheme. The controller may be configured to determine the idle condition of the boat based, at least in part, on a throttle control for the boat. The controller may be configured to determine the idle condition of the boat based, at least in part, on a position of a mechanical component of the throttle control for the boat. The controller may be configured to activate an indicator based, at least in part, on the idle condition. The indicator may be arranged to be sensed by an occupant of the boat. The indicator may be arranged to be sensed by a person outside the boat. The controller may be configured to maintain a state of the engine based, at least in part, on the idle condition. The state of the engine may include a temperature of the engine. The auxiliary power source may include an electric power source.

A marine control system may include a controller, one or more connections for one or more control inputs, and one or more connections for an engine, wherein the controller may be configured to determine an idle condition of a boat based, at least in part on at least one of the one or more control inputs, deactivate the engine based, at least in part, on the idle condition, determine a demand for the mechanical output power for the boat based, at least in part, on at least one of the one or more control inputs, and activate the engine using at least one of the one or more connections for the engine based, at least in part, on the demand. The system may further include one or more connections for an indication.

A method may include providing, by an engine, mechanical output power for a boat, determining an idle condition of the boat, disabling the engine based, at least in part, on the idle condition, determining a demand for the mechanical output power for the boat, and enabling, using an auxiliary power source, the engine based, at least in part, on the demand.

BRIEF DESCRIPTION OF THE DRAWINGS

The figures are not necessarily drawn to scale and elements of similar structures or functions may generally be represented by like reference numerals, or portions thereof, for illustrative purposes throughout the figures. The figures are only intended to facilitate the description of the various embodiments described herein. The figures do not describe every aspect of the teachings disclosed herein and do not limit the scope of the claims. To prevent the drawings from becoming obscured, not all of the components, connections, and the like may be shown, and not all of the components may have reference numbers. However, patterns of component configurations may be readily apparent from the drawings.

DETAILED DESCRIPTION

Overview

Figure 1:
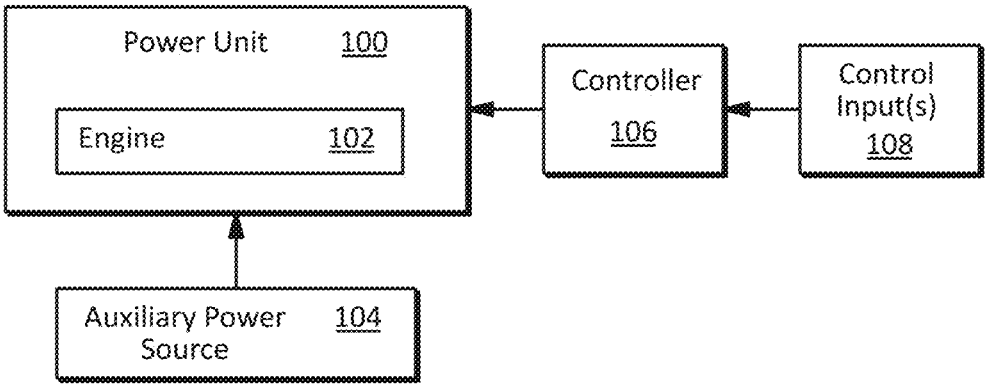
FIG. 1 illustrates an embodiment of a scheme for controlling a boat engine in accordance with the inventive principles of this patent disclosure.

Some of the inventive principles of this patent disclosure relate to schemes for deactivating a boat engine (e.g., turning it off) under idle conditions and/or reactivating the engine (e.g., turning it back on) in response to a demand for power. For example, in some embodiments, a marine power unit may include an internal combustion engine that may stop running when an operator places a throttle control for the engine in a neutral position. The engine may then restart when the operator grips the throttle control, releases a neutral interlock for the throttle control, and/or performs any other action indicating a demand for power from the engine.

The inventive principles may be implemented with an unlimited range of operational details relating to detecting an idle condition of the boat, stopping the engine, maintaining the engine while it is off, detecting a demand for power from the engine, restarting the engine, and/or any other operation aspects.

For example, some embodiments may implement a time delay between detecting an idle condition and deactivating the engine to prevent the engine from shutting off during activities that may include numerous, short engine idle periods. As another example, some embodiments may implement one or more qualifier, safety, and/or interlock features such as disabling an idle deactivation feature for certain operators, requiring an operator to actuate one or more interlocking sensors, switches, or buttons to reactivate the engine, and/or providing a visual and/or audio indicator of an idle deactivation feature to occupants and/or others near the boat.

Boat Engine Controls

A boat engine may be controlled by a throttle control that may have, for example, a lever that an operator may manipulate to control the amount of power provided by an engine, and/or engage a transmission (if any) to control the direction of propulsion (e.g., forward or reverse) provided by the engine. A throttle lever may have a neutral position in which it may cause the engine to operate at an idle speed (e.g., slow or slowest speed). When the throttle lever is in the neutral position, it may also place the transmission in a neutral state in which power from the engine is not mechanically coupled to a propulsion device such as a propeller, jet pump, and/or the like.

In some implementations, the throttle control may include a neutral interlock that may require the operator to raise (e.g., pull) a collar on the lever, press a button, and/or the like, to enable the throttle lever to move out of the neutral position. In some implementations, the throttle control may include a start interlock that may prevent the operator from starting the engine unless the throttle lever is in the neutral position. For example, the operator may place an ignition switch in a "run" position to enable power to the engine and/or boat accessories before starting the engine. The operator may then momentarily place the ignition switch in a "start" position to start the engine. In an implementation with a start interlock, the engine may not start unless the throttle lever is in the neutral position.

After starting the engine, as the operator progressively moves the throttle lever forward from the idle position, the throttle control may gradually increase the amount of output power provided by the engine. Simultaneously with, or prior to, increasing the power provided by the engine, moving the throttle lever forward may engage the transmission to couple the output power from the engine to a propulsion device. For example, in some implementations, the throttle lever may be configured to completely engage the transmission in the forward direction before increasing the engine power above the idle level. At the furthest extent of forward movement of the throttle lever, the engine may operate at full power. Progressively moving the throttle lever backward to the neutral position may cause the throttle control to gradually decrease the output power provided by the engine until reaching the neutral position at which point the throttle control may reduce the engine power to the idle level and/or place the transmission in a neutral state.

Some boat engine controls may also include a reverse range in which, as the operator progressively moves the throttle lever backward from the idle position, the throttle control may gradually increase the amount of output power provided by the engine and engage the transmission in a reverse direction. The operation in the reverse direction may be essentially the same as that in the forward direction with the exception of engaging the transmission in the reverse direction. In some implementations, the throttle control may limit the amount of power provided by the engine in the reverse direction.

Idle Conditions

There are many boating situations in which there may be little or no demand for power from a boat engine. Examples may include floating slowly down a wide river, stopping for fishing, swimming, or socializing, preparing a participant for water skiing, tubing, wakeboarding, and/or the like, and many other activities. In such situations, the engine may be turned off by the operator to reduce fuel consumption, emissions, wear and/or depreciation of the engine, and/or the like.

However, in some idle situations such as these, it may be inconvenient or even unsafe to turn off the engine. For example, while operating in moving water (e.g., on a river), turning off the engine may be relatively unsafe because it may reduce the operator's ability to maneuver under power immediately if the current of the moving water begins moving the boat toward a hazard. Depending on the details, this may create an economic penalty for an operator that decides to operate safely by leaving the engine running while floating in moving water.

As another example, requiring an operator to manually start an engine in some situations may distract the operator's attention from other tasks such as watching for approaching swimmers, watercraft, and/or the like, monitoring other occupants of the boat for safe behavior, and/or monitoring equipment for navigation, depth finding, communication, and/or the like. Moreover, requiring an operator to manually start an engine in some situations may require the operator to use a hand/arm that may be better used for any of the tasks mentioned above, as well as operating fishing gear, steading the operator in rough waters, and/or the like.

Engine Idle Deactivation

FIG. 1 illustrates an embodiment of a scheme for controlling a boat engine in accordance with the inventive principles of this patent disclosure. The embodiment illustrated in FIG. 1 may include a marine power unit 100 and an auxiliary power source 104. The power unit 100 may include an engine 102 arranged to provide mechanical output power for a boat. The auxiliary power source 104 may be arranged to activate (e.g., start) the engine 102. The embodiment illustrated in FIG. 1 may also include a controller 106 arranged to control the engine and/or the auxiliary power source based on one or more control inputs 108. The controller may be configured to determine an idle condition of the boat, deactivate the engine based, at least in part, on the idle condition, determine a demand for the mechanical output power for the boat, and activate, using the auxiliary power source, the engine based, at least in part, on the demand. For example, in some embodiments, the idle condition may be determined by sensing a throttle control in a neutral position, and the demand may be determined by sensing an interlock being released to enable the throttle control to move out of the neutral position.

The embodiment illustrated in FIG. 1 is not limited to any specific implementation details. However, for purposes of illustrating the inventive principles, some embodiments may include any of the following implementation details. In some embodiments, the engine 102 may be implemented with one or more engines suitable for marine use including, for example, internal combustion engines and/or turbine engines fueled with gasoline, diesel fuel, propane, natural gas, and/or the like. As used herein, the term engine may refer to one or more engines (e.g., two tandem mounted engines). In some embodiments, the power unit 100 may include one or more transmissions and/or other power train components including one or more propulsion devices such as propellers, jet pumps, and/or the like.

In some embodiments, the power unit 100, or any power unit disclosed herein, may be implemented as a packaged power unit that may include an engine and one or more supporting apparatus such as an air or liquid-based cooling system, air intake system, fuel system, ignition system, throttle and/or speed control/governor, exhaust system, electric power generation system, air compressor, starter motor, and/or the like. In some embodiments, the auxiliary power source 104 may be implemented, for example, with one or more of an electric battery, an electric generator, an air tank for a pneumatic starter motor, and/or the like. In some embodiments, the auxiliary power source 104 may be implemented as an integral part of an engine 102 that may have self-starting capabilities such as with direct fuel injection. In some embodiments, the auxiliary power source 104 may be implemented with one or more energy harvesting devices that may obtain energy from the environment.

In some embodiments, the controller 106 and/or control inputs 108, or any controllers and/or control inputs disclosed herein, may be implemented with one or more apparatus based on mechanical, electric, pneumatic, hydraulic, and/or other principles, or a combination thereof. For example, a mechanical controller and/or controls may include any arrangement of levers, cams, cables, linkages, wheels, knobs, buttons, and/or the like. An electric controller and/or controls may include any arrangement of switches, buttons, joysticks, sensors, wires, circuits, modules, keyboards, displays, and/or the like. A pneumatic and/or hydraulic controller and/or controls may include any arrangement of valves, tubes, hoses, actuators, tanks, accumulators, and/or the like.

In embodiments in which the controller 106 and/or control inputs 108 may be implemented at least partially with electric components, any of the functionality of the controller 106 and/or control inputs 108 may be implemented with hardware, firmware, software or a combination thereof including analog and/or digital circuitry and/or other components such as relays, switches, amplifiers, A/D converters, D/A converters, output drivers, power supplies, wired and/or wireless transmitters, receivers, combinational logic, sequential logic, one or more timers, counters, registers, and/or state machines, one or more programmable logic devices such as complex programmable logic devices, (CPLDs) and/or field programmable gate arrays (FPGAs), application specific integrated circuits (ASICs), processing units (CPUs) such as microcontrollers, microprocessors, and/or the like executing instructions stored in any type of memory, or any combination thereof.

In some embodiments, some or all of the functionality of the controller 106 and/or control inputs 108 may be integrated into an existing boat engine control system. For example, in an electronic boat engine control system including an electronically controlled throttle (e.g., a "fly-by-wire" control system), some or all of the functionality of the controller 106 and/or control inputs 108 may be implemented by programming the functionality into existing program code for one or more microcontrollers and/or microprocessors in the system, with the possible addition of one or more components such as a switch to sense the position (e.g., idle position) of a throttle control lever, a safety interlock therefore, and/or the like.

In some embodiments, some or all of the functionality of the controller 106 and/or control inputs 108 may be provided as an add-on system (e.g., an aftermarket kit) that may be retrofitted to an existing boat engine control system. For example, the embodiment illustrated in FIG. 2 and described below may be provided to a boat owner, servicer, boat manufacturer, and/or the like, as an accessory kit that may be added to an existing boat engine control system.

Figure 2:
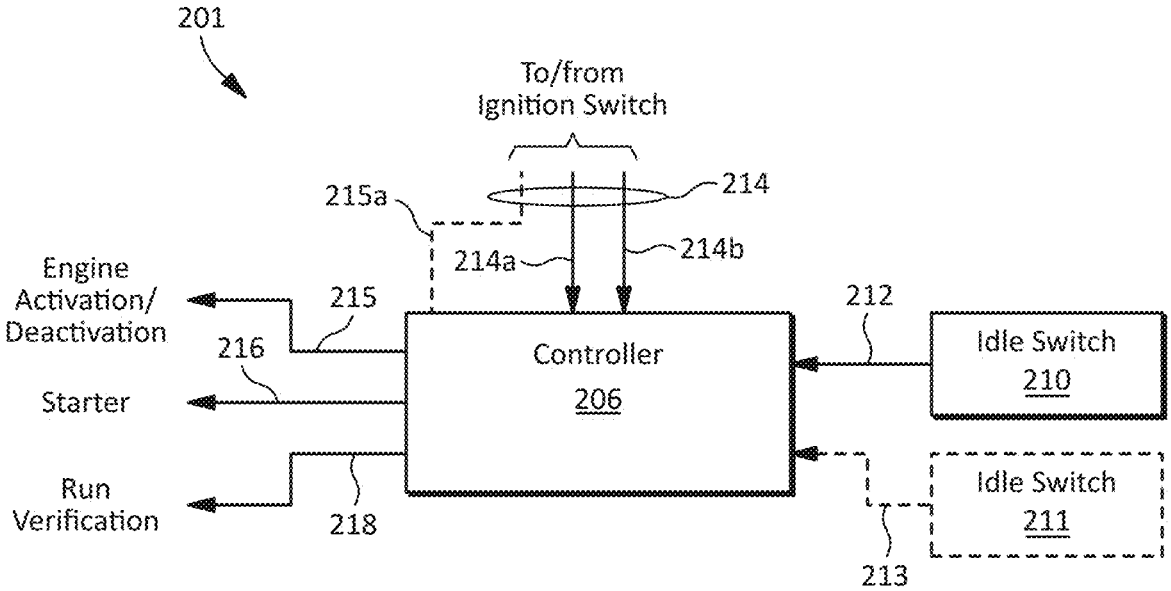
FIG. 2 illustrates an example embodiment of a boat engine control system in accordance with the inventive principles of this disclosure.

FIG. 2 illustrates an example embodiment of a boat engine control system in accordance with the inventive principles of this disclosure. The system 201 illustrated in FIG. 2 may include a controller 206 that may be used, for example, to implement the controller 106 illustrated in FIG. 1.

Referring to FIG. 2, the system 201 may include an idle switch 210 that may be attached to a mechanical throttle control such as a cable type throttle lever (e.g. a Morse style throttle control lever) such that the idle switch 210 may close (or open) when the throttle lever is moved to the neutral position. In such embodiments, the idle switch 210 may be arranged such that the switch may open (or close) when the throttle lever is moved out of the neutral position, for example, after an interlock collar is lifted, an interlock latch is disengaged by pressing it, and/or the like, and the throttle lever is moved slightly out of the neutral position (e.g., in a forward or reverse direction).

Alternatively, in some embodiments, the idle switch 210 may be attached to a neutral interlock mechanism of a mechanical throttle control in such a manner that the switch may close (or open) when the neutral interlock is engaged (e.g., when an interlock collar is allowed to drop, an interlock latch is engaged by allowing it to pop out, and/or the like) when the throttle lever is moved to the neutral position. In such embodiments, the idle switch 210 may be arranged such that the switch may open (or close) when the neutral interlock is disengaged (e.g., when an interlock collar is lifted, an interlock latch is disengaged by pressing it, and/or the like).

Some embodiments may include more than one idle switch. For example, a first idle switch 210 may be mechanically attached to a mechanical throttle control in such a manner as to sense when the throttle lever is in or out of the neutral position, and a second idle switch 211 may be mechanically attached to a mechanical throttle control in such a manner as to sense whether a neutral interlock is engaged or disengaged.

In some embodiments, one or more of the idle switches 210 and/or 211 may be implemented with any type of sensor that may enable the controller 206 to determine an idle condition and/or a demand for power. For example, one or more of the idle switches 210 and/or 211 may be implemented with one or more proximity sensors, touch sensors, optical encoders and/or interrupters, and/or the like, as well as any type of mechanical, pneumatic, and/or hydraulic sensor devices.

The system 201 may include one or more connections 214 to an ignition switch. For example, a first connection **214*a*** may provide electric power to the controller 206 when the ignition switch is in a run and/or start position (e.g., placing the engine in a run state). A second connection 214*b* may provide a signal that may let the controller 206 know when an operator has moved the ignition switch to the start position.

The system 201 may also include an engine activation/deactivation connection 215 that may be arranged to turn off the engine, for example, by disconnecting power to an ignition system, disabling a fuel pump, sending a stop signal to an engine control module (ECM), activating a stop solenoid, and/or the like. In various embodiments, the engine activation/deactivation connection 215 may be implemented with a digital signal, a relay, a solenoid, and/or the like. In some embodiments, the engine activation/deactivation connection 215 may be routed to the ignition switch as shown by dashed line 215*a*. In such an embodiment, the engine activation/deactivation connection 215 may override the run signal from the ignition switch to activate and/or deactivate the engine (e.g., by placing a relay in series with a run wire that may be routed between the ignition switch and the engine to enable the controller 206 to turn the engine on and/or off in a manner similar to the ignition switch).

The system 201 may also include a start connection 216 to a starter motor or other engine activation mechanism. For example, the connection 216 may be implemented with a relay contact that may engage a starter motor to start the engine.

In some embodiments, the system 201 may also include a run verification connection 218 that may provide closed-loop feedback to enable the controller 206 to verify that the engine has started in response to activating the start connection 216. For example, the run verification connection 218 may be coupled to a terminal of an ignition coil, an inductive pickup for an ignition wire, an engine speed and/or crankshaft position sensor, and/or the like.

In an embodiment in which the system 201 may be provided as an add-on system (e.g., an aftermarket kit), the controller 206 and idle switch 210 may provided along with a wiring kit that may include one or more wires for one or more of the connections 212, 213, 214, 215, 216, and/or 218 along with terminals, connectors, splices and/or the like to enable the system 201 to be installed on a boat.

Figure 3:
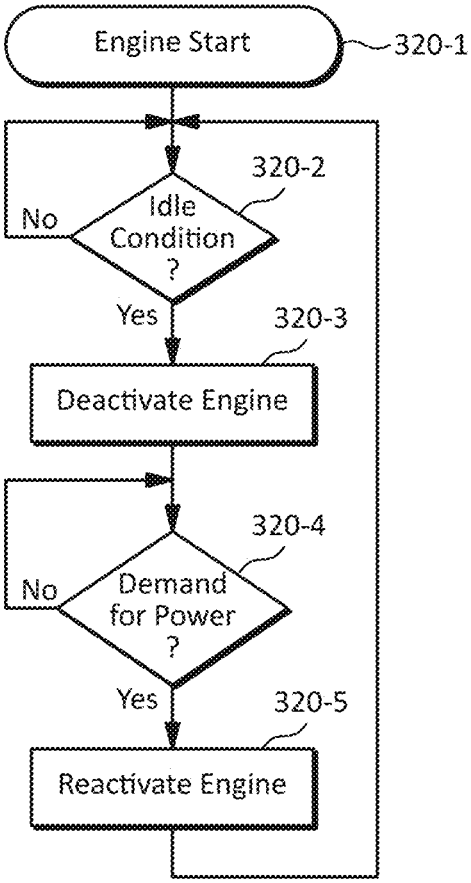
FIG. 3 illustrates a flow chart of a method for controlling a boat engine in accordance with the inventive principles of this disclosure.

FIG. 3 illustrates a flow chart of a method for controlling a boat engine in accordance with the inventive principles of this disclosure. The method illustrated in FIG. 3 may be used, for example, with the control system 201 illustrated in FIG. 2, and will be described in the context of the control system 215 illustrated in FIG. 2. However, the method illustrated in FIG. 3 may also be implemented with any other control system in accordance with the inventive principles of this disclosure. For example, the method illustrated in FIG. 3 may be implemented using digital and/or analog electric logic, sensors, and/or outputs, mechanical logic, sensors, and/or outputs, pneumatic logic, sensors, and/or outputs, hydraulic logic, sensors, and/or outputs, or any combination thereof.

Referring to FIG. 3, the method may begin at operation 320-1 when the controller 206 detects that a boat engine has started, for example, by sensing an active signal on the start connection 214*b* and/or the run verification connection 218.

At operation 320-2, the controller 206 may detect whether an idle condition exists, for example, by detecting that a throttle lever is in a neutral position (e.g., using switch 210) and/or that a neutral lock has been engaged (e.g., using switch 211). If an idle condition is not detected, the method may continue looping through operation 320-2.

If, however, an idle condition is detected at operation 320-2, the method may proceed to operation 320-3 where the controller 206 may deactivate the engine, for example, by deactivating the engine activation/deactivation connection 215. The method may then proceed to operation 320-4. In some embodiments, in the deactivated state, a broader power unit may continue to operate (e.g., using power provided by a battery or other auxiliary power source) to provide power to the controller 206 and/or any other boat accessories such as navigation systems, boat monitoring systems, entertainment systems, air conditioners and/or the like, even though the engine may be deactivated.

At operation 320-4, the controller 206 may detect whether a demand for power from the engine, for example, by detecting that the throttle lever has moved from an idle position (e.g., by switch 210) and/or that a neutral interlock has been disengaged (e.g., by switch 211). If a demand for power is not detected, the method may continue looping through operation 320-4.

However, if a demand for power is detected at operation 320-4, the method may proceed to operation 320-5 where the controller 206 may start the engine, for example, by activating the engine activation/deactivation connection 215 and/or temporarily activating the start connection 216. In some embodiments, the controller 206 may activate the start connection 216 for a predetermined period of time and assume the engine has started (e.g., an open-loop starting operation). In some embodiments, the controller 206 may activate the start connection 216 until it determines by the run verification connection 218 that the engine has actually started (e.g., a closed-loop start). The method may then return to operation 320-2.

In some embodiments, the method may continue looping through the operations illustrated in FIG. 3, for example, until the ignition switch is turned off, thereby disabling power to the controller 206 (e.g., through run connection 214*a*).

In some embodiments, a method for engine idle deactivation in accordance with the inventive principles of this disclosure may implement a time delay before deactivating a boat engine. For example, rather than deactivating the engine immediately after detecting an idle condition, the engine may be allowed to continue running for a period of time (which may be referred to as a delay interval, a shutoff interval, and/or the like). If, during the entire time period, the boat remains in the idle condition, the engine may then be deactivated when the time period expires. However, if at any point during the time delay, the idle condition no longer exists (e.g., a demand for power is detected, for example, by detecting a throttle lever being moved out of a neutral position), the engine may resume normal operation and the engine deactivation process may be discontinued.

In some embodiments, implementing a time delay may prevent the engine from being turned off during normal short-duration idle periods, for example, while stopping to land a fish, allow simmers, water skiers, and/or the like to embark or disembark from the boat, and/or the like.

In some embodiments, the time interval between detecting an idle condition and deactivating the engine may be set to a default value and/or may be set to an adjustable duration by a manufacturer, servicer, operator, and or the like. In some embodiments, a manufacturer, servicer, operator, and/or the like, may define one or more predetermined time delays and/or other parameters. For example, one or more different predetermined and/or specific time delays may be implemented for when a boat is being used for towing for various activities including specific watersports. In some embodiments, an engine idle deactivation feature in accordance with the inventive principles may be deactivated, for example, by an operator. In some embodiments, the time interval may be adjustable based on an operator or rider's preference, the specific tow sport, as well as other factors. In some embodiments, an engine idle deactivation feature in accordance with the inventive principles may be disabled by default when the engine is first started until the engine reaches its normal operating temperature range.

Figure 4:
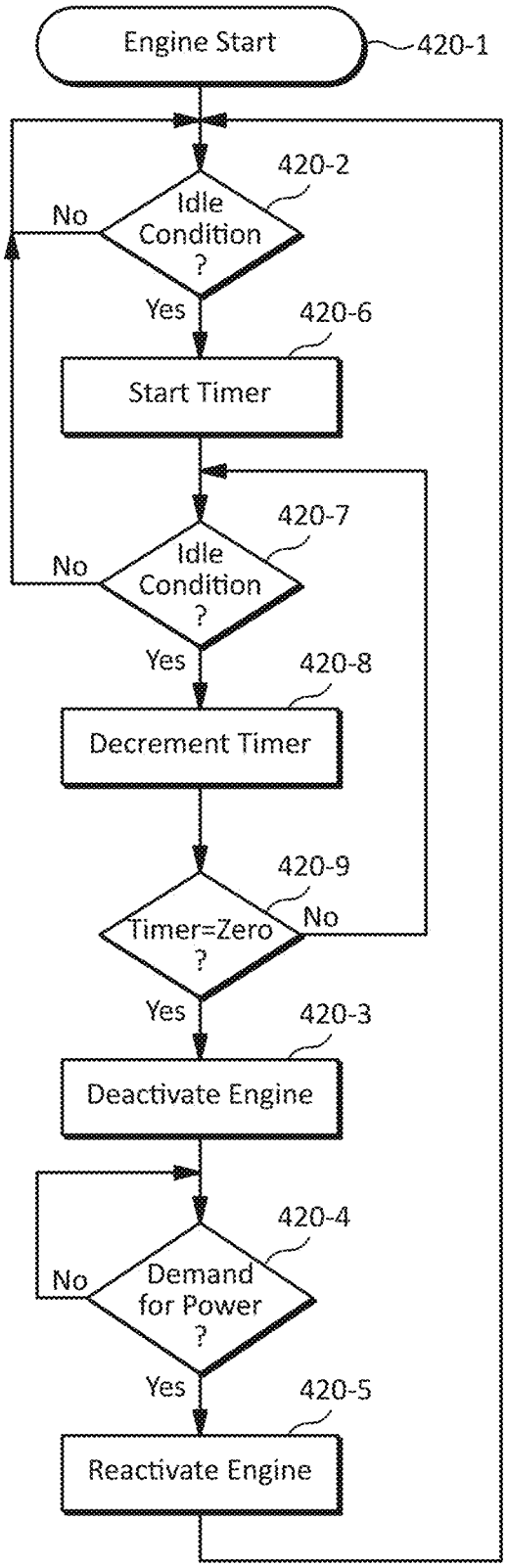
FIG. 4 illustrates a flow chart of a method for controlling a boat engine having a time delay before deactivating an engine in accordance with the inventive principles of this disclosure.

FIG. 4 illustrates a flow chart of a method for controlling a boat engine having a time delay before deactivating an engine in accordance with the inventive principles of this disclosure. The method illustrated in FIG. 4 may be used, for example, with the control system 201 illustrated in FIG. 2, and will be described in the context of the control system 201 illustrated in FIG. 2. However, the method illustrated in FIG. 4 may also be implemented with any other control system in accordance with the inventive principles of this disclosure. For example, the method illustrated in FIG. 4 may be implemented using digital and/or analog electric logic, sensors, and/or outputs, mechanical logic, sensors, and/or outputs, pneumatic logic, sensors, and/or outputs, hydraulic logic, sensors, and/or outputs, or any combination thereof.

Referring to FIG. 4, the method may begin at operation 420-1 when the controller 206 detects that a boat engine has started, for example, by sensing an active signal on the start connection 214*b* and/or the run verification connection 218.

At operation 420-2, the controller 206 may detect whether an idle condition exists, for example, by detecting that a throttle lever is in a neutral position (e.g., using switch 210) and/or that a neutral lock has been engaged (e.g., using switch 211). If an idle condition is not detected, the method may continue looping through operation 420-2.

If, however, an idle condition is detected at operation 420-2, the method may proceed to operation 420-6 where the controller 206 may start a count-down timer, for example, by loading it with a number representing a predetermined time delay. At operation 420-7, the controller 206 may again check to determine whether the idle condition still exists. If at operation 420-7 the idle condition is determined to no longer exist, the controller may discontinue the countdown process and return to operation 420-2, thereby allowing the engine to remain in a normal operating mode.

If, however, at operation 420-7, the controller 206 determines that the idle condition still exists, the method may proceed to operation 420-8 where the controller 206 may decrement the count-down timer (e.g., each time through a loop including operations 420-7, 420-8, and 420-9 which may take a known amount of time). At operation 420-9, the controller 206 may determine whether the time delay has ended (e.g., the count-down timer has reached zero). If the time delay has not ended, the method may continue looping through operations 420-7, 420-8, and 420-9 until the time delay has ended (or the idle condition is determined to no longer exist at operation 420-7).

If, at operation 420-9 the controller 206 determines that the time delay has ended, the method may proceed to operation 420-3 where the controller 206 may deactivate the engine, for example, by deactivating the engine activation/deactivation connection 215. The method may then proceed to operation 420-4. In some embodiments, in the deactivated state, a broader power unit may continue to operate (e.g., using power provided by a battery or other auxiliary power source) to provide power to the controller 206 and/or any other boat accessories such as navigation systems, boat monitoring systems, entertainment systems, air conditioners and/or the like, even though the engine may be deactivated.

At operation 420-4, the controller 206 may detect whether a demand for power from the engine, for example, by detecting that the throttle lever has moved from an idle position (e.g., by switch 210) and/or that a neutral interlock has been disengaged (e.g., by switch 211). If a demand for power is not detected, the method may continue looping through operation 420-4.

However, if a demand for power is detected at operation 420-4, the method may proceed to operation 420-5 where the controller 206 may start the engine, for example, by activating the engine activation/deactivation connection 215 and/or temporarily activating the start connection 216. In some embodiments, the controller 206 may activate the start connection 216 for a predetermined period of time and assume the engine has started (e.g., an open-loop starting operation). In some embodiments, the controller 206 may activate the start connection 216 until it determines by the run verification connection 218 that the engine has actually started (e.g., a closed-loop start). The method may then return to operation 420-2.

In some embodiments, the method may continue looping through the operations illustrated in FIG. 4, for example, until the ignition switch is turned off, thereby disabling power to the controller 206 (e.g., through run connection 214*a*).

Figure 5:
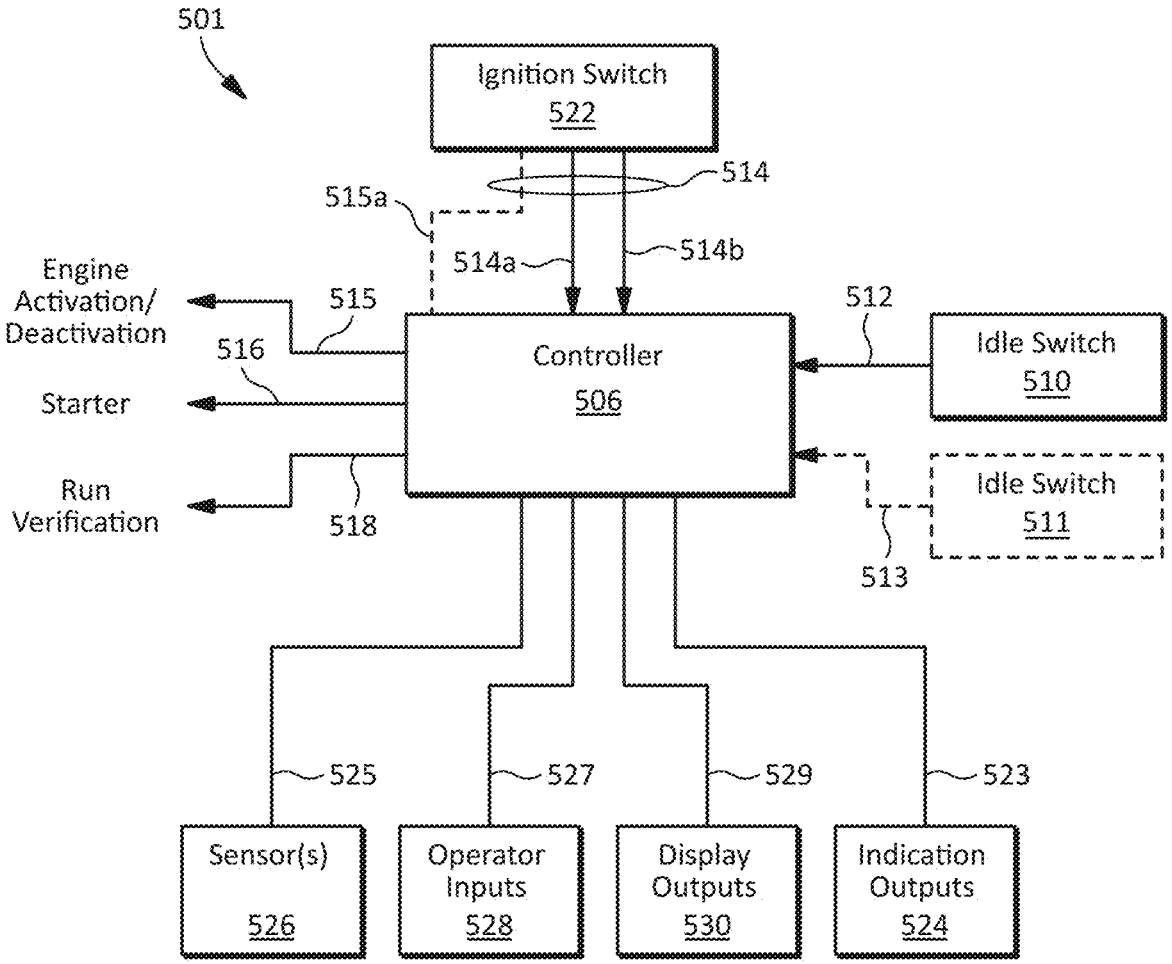
FIG. 5 illustrates another example embodiment of a boat engine control system in accordance with the inventive principles of this disclosure.

FIG. 5 illustrates another example embodiment of a boat engine control system in accordance with the inventive principles of this disclosure. The system 501 illustrated in FIG. 5 may include a controller 506 that may be used, for example, to implement the controller 106 illustrated in FIG. 1.

Referring to FIG. 5, the system 501 may include some or all components similar to those illustrated in FIG. 2 including, for example, one or more idle switches such as a first idle switch 510 and/or a second idle switch 511, one or more connections 514 to an ignition switch, an engine activation/deactivation connection 515, a start connection 516, and/or a run verification connection 518. In some embodiments, the system 501 may further include one or more additional components that may be configured and/or arranged to implement one more additional features in accordance with the inventive principles of this disclosure.

For example, the system 501 may include an ignition switch 522 that may be configured to provide an additional position such that it may allow for propulsion (e.g., maintaining the engine in an active state) in a first (e.g., "on" or "run") position and no propulsion in a second (e.g., "off") position (e.g., maintaining the engine in a deactivated state) while adding a third state that may enable an engine idle deactivation feature as disclosed herein. Thus, in the third state, the engine may be deactivated, for example, based on the controller 506 detecting an idle condition but ready to reactivate the engine based on the controller 506 detecting a demand for propulsion. In some embodiments, the ignition switch 522 may be configured such that the third position may only be available using a specific type of key that may be different from a normal key. In some embodiments, an engine idle deactivation feature may be available in the second position (e.g., without a third position), but only for an operator using a specific type of key. Depending on the implementation details, this may enable an engine idle deactivation feature to be withheld, for example, from less experienced operators. A specific type of key may be implemented, for example, with a mechanical key having a different cut, an electronic key (e.g., a wireless key fob) with different programming, and/or the like. In some embodiments, the ignition switch 522 may be located one or at an engine control, e.g., at or on a throttle lever, at or near a dashboard, and/or the like.

In some embodiments, the system 501 may include one or more output connections 523 that may activate one or more indicators 524 to let operators and/or occupants of the boat, and/or any persons that may be in the vicinity of the boat know that an engine idle deactivation feature may be operating (e.g., the engine is in a standby state), the boat engine may start at any time, and/or the boat may move at any time, even though the boat engine may not currently be running. Examples of indicators may include visual signals such as steady and/or flashing lights (e.g., LED lights, strobe lights, etc., in any color such as red), audio signals such as beepers, chimes, synthetic engine sounds, and/or the like. Examples of locations for one or more indicators may include a dashboard, an engine control (e.g., a throttle lever), a bulkhead, a gunwale, a bow, a transom, a swimming platform, a mast, and/or the like.

In some embodiments, the system 501 may further include one or more connections 525 for one or more sensors 526 that may be used to implement one or more features such as detecting a water speed of the boat to detect an idle condition, detecting that the boat has been removed from the water (e.g., transferred to a trailer) to disable an engine idle deactivation feature, and/or the like.

In some embodiments, the system 501 may further include one or more connections 527 for one or more operator inputs 528 and/or one or more connections 529 for one or more display outputs 530 that may enable the controller 506 to implement one or more additional features in accordance with the inventive principles of this disclosure. In some embodiments, the one or more operator inputs 528 may include one or more switches, buttons, joysticks, encoders, touch sensors, touchscreens, keypads, keyboards, microphones, cameras, and/or the like. In some embodiments, the one or more display outputs 530 may include one or more lights, electronic displays (e.g., LED, LCD, etc.), speakers, beepers, haptic devices, and/or the like.

Examples of features that may be implemented by the controller 506 using the one or more operator inputs 528 and/or one or more display outputs 530 may include inputting one or more parameters for the operation of the control system 501 such as a delay time for deactivating the engine after detecting an idle condition, an engine warm-up time during which an engine idle deactivation feature may not be enabled, a time limit for which the controller 506 may keep the engine in a deactivated state after detecting an idle condition (which may default, e.g., to one hour), for example, to prevent a battery of an auxiliary power source from draining if the boat left unattended (e.g., at a dock) while the controller 506 is operating under battery power, and/or the like.

Another example of a feature that may be implemented by the controller 506 using the one or more operator inputs 528 and/or one or more display outputs 530 may include reporting hours the engine is actively in combustion mode, for example, in addition to, and/or instead of, hours the entire power unit is active. Depending on the implementation details, this may provide an economic incentive for operators to use an engine idle deactivation feature as disclosed herein as it may facilitate higher resale value in addition to reduced fuel consumption. In some embodiments, an engine idle deactivation feature as disclosed herein may enable usage periods during which a power unit is enabled but the engine is deactivated (e.g., engine RPMs are zero), thus, need not be logged as run time.

Another example of a feature that may be implemented by the controller 506 may include a power limiting mode that may impose a limit on the amount of power provided by the engine as it is reactivated. In some embodiments, this feature may be available by default, with operator customization to impose safety-oriented limitations. For example, in some embodiments, this mode may enable the operator to engage the throttle, but only at a limited engine power level. Depending on the implementation details, this may prevent sudden dramatic throttle movements. In some situations, this may represent the vast majority use required since adjustments for current, obstacles, traffic, and/or the like, may be minor and/or applied gradually. Additional safeguards may be implemented to unlock some or all of the power capabilities of the engine in one or more increments. For example, the maximum power output of the engine may be increased by percentage for each unit of time (e.g., number of seconds). In some embodiments, one or more parameters of a power limiting mode such as a power increment, a time increment, and/or the like, may be input by an operator using the one or more operator inputs 528 and/or one or more display outputs 530.

Figure 6A:
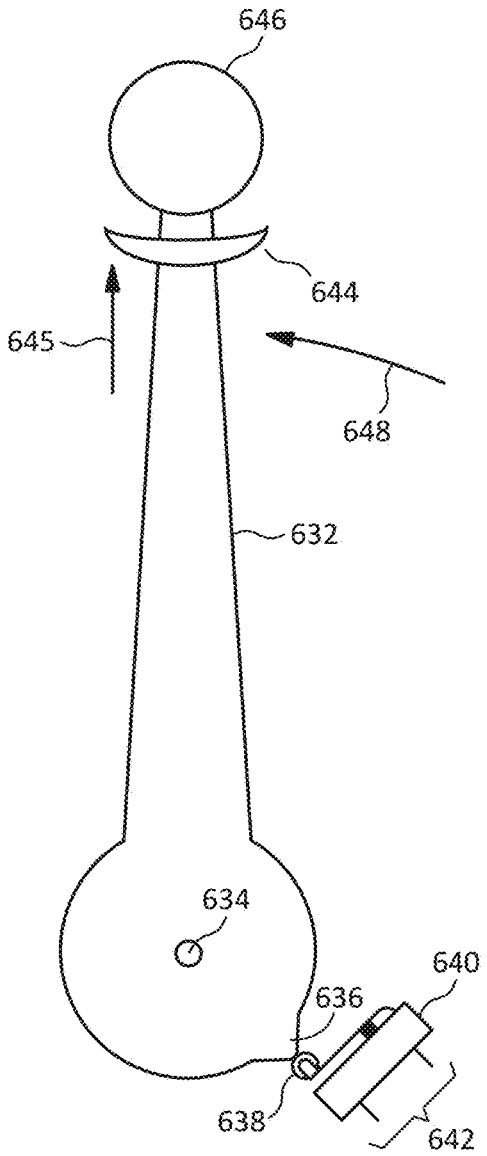
FIGS. 6A and 6B illustrate an embodiment of a scheme for determining the position of a boat throttle lever in accordance with the inventive principles of this disclosure.
Figure 6B:
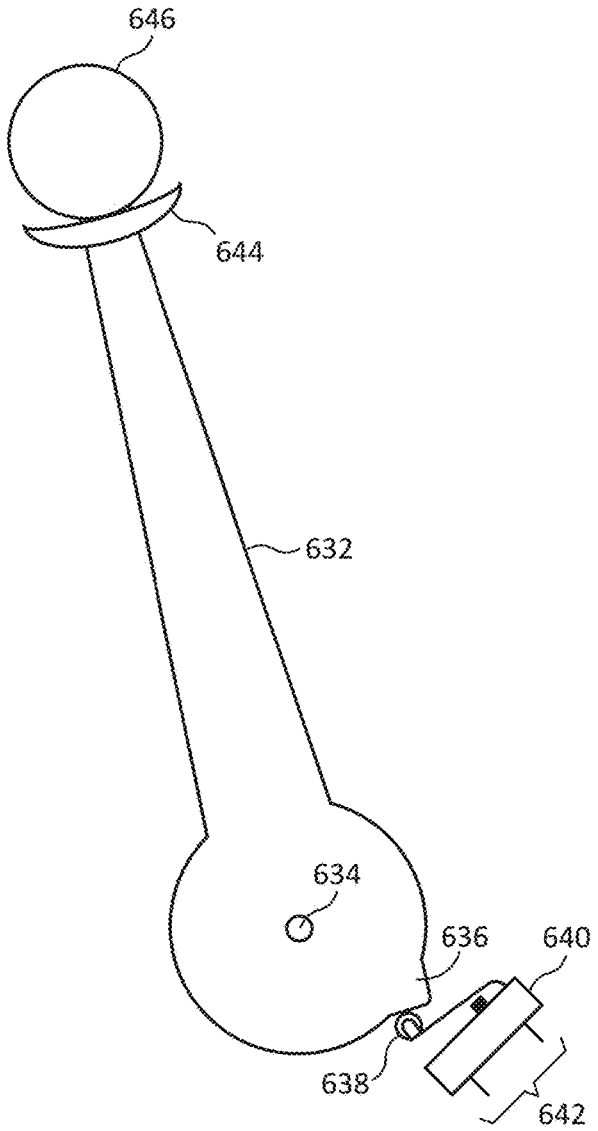

FIGS. 6A and 6B (referred to collectively as FIG. 6) illustrate an embodiment of a scheme for determining the position of a boat throttle lever in accordance with the inventive principles of this disclosure. In the embodiment illustrated in FIG. 6A, the throttle lever may include a shaft 632 arranged to rotate around a pivot point 634. The shaft 632 may include a cam portion having a lobe 636 that may engage a roller actuator 638 of a microswitch 640. In the view of FIG. 6A, the throttle lever may be in a neutral position, and the cam lobe 636 may depress the actuator 638 thereby closing (or opening) one or more contacts in the microswitch 640. The switches may be electrically connected, for example, to a controller (e.g., 106, 206, 506) through one or more sets of contacts 642.

Referring to FIG. 6B, an operator may rotate the throttle lever to a forward position by first pulling up on an interlock collar 644 as shown by arrow 645 while pushing forward on a grip 646 as shown by arrow 648. In the position shown in FIG. 6B, the shaft 632 has rotated slightly such that the cam lobe 636 no longer engages the roller actuator 638 of the microswitch 640, thereby opening) or closing the contacts in the microswitch 640.

Figure 7A:
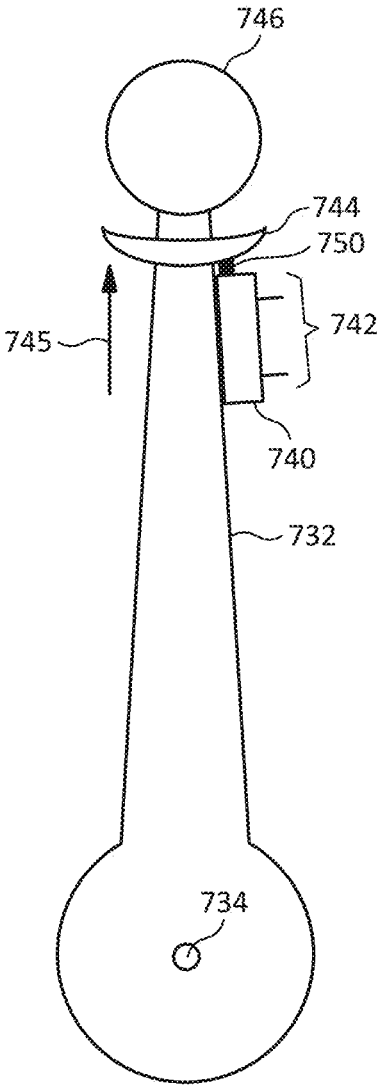
FIGS. 7A and 7B illustrate another embodiment of a scheme for determining the position of a boat throttle lever in accordance with the inventive principles of this disclosure.
Figure 7B:
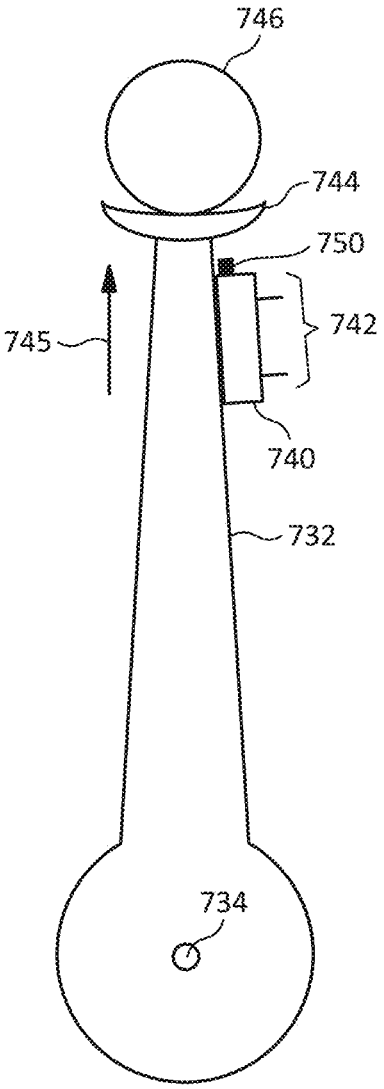

FIGS. 7A and 7B (referred to collectively as FIG. 7) illustrate another embodiment of a scheme for determining the position of a boat throttle lever in accordance with the inventive principles of this disclosure. In the embodiment illustrated in FIG. 7A, the throttle lever may include a shaft 732 arranged to rotate around a pivot point 734. A plunger or other type of switch 740 may be arranged to engage an interlock collar 744 such that, when the interlock is engaged (e.g., lowered to lock the throttle lever in the neutral position) the collar may engage a plunger 750 of the switch 740, thereby closing (or opening) a set of contacts that may be connected to a controller e.g., 106, 206, 506) through one or more sets of terminals 742. To move the throttle lever out of the neutral position, an operator may disengage (e.g., pull up on) the interlock collar 744 as shown by arrow 745, thereby disengaging the plunger 750 and opening (or closing) the contacts.

The embodiments illustrated in FIGS. 6 and 7 illustrate just two of an unlimited number of possible configurations for determining an idle condition of a boat in accordance with the inventive principles of this disclosure. In other embodiments, switches or other sensors may be located anywhere on an engine control and may be implemented with optical sensors, touch sensors, proximity sensors, and/or the like. For example, in some embodiments, a switch or other sensor may be implemented with one or more sensors, switches or buttons on the top of the throttle itself. In some embodiments, a button may be arranged to be activated by the natural gripping of the top of the throttle itself. In some embodiments, a trigger or grip activated mechanism on the throttle may also be used to determine a demand for engine power and reactivate the engine.

In some embodiments, a covered two-step arming safety switch (e.g., military missile style) on or adjacent to the throttle may be used to determine a demand for engine power and reactivate the engine. The cover may be used, for example, to prevent accidental operation. In some embodiments, a covered two-step arming safety switch may be implemented, for example, with a start and/or stop ignition switch on or at the throttle. Depending on the implementation details, this scheme may be operated with a single hand. In some embodiments, however, the safety switch may be arranged to require two hands, for example, by placing the safety switch at a location other than the throttle control.

In some embodiments, a switch requiring an operator to hold the switch in an active position (e.g., a "dead man's switch" as used in railroad equipment) may be used to determine a demand for engine power and reactivate the engine. Thus, the switch may be actuated by the operator holding it in an active position (e.g., rather than a binary on/off position).

In some embodiments, one or more switches used to determine a demand for engine power and reactivate the engine may be located in two places, for example, pairing one switch with an ignition switch position. This may be implemented, for example, using a push-to-start ignition switch (e.g., as opposed to a turning-type ignition switch).

In some embodiments, a used to determine a demand for engine power and reactivate the engine may be incorporated into the steering wheel, seat, and/or the like, for example, to ensure that the operator is in full control when activating propulsion.

In some embodiments, one or more additional actions such as twisting a throttle control, pushing a throttle control sideways, navigating a throttle control through a gate (e.g., as with an automotive shifter), squeezing part of a throttle control, and/or the like, as part of a process to determine a demand for power and reactivate the engine for propulsion may provide one or more additional layers of safety. In some embodiments, a throttle control may have a concave shape on the top with a start and/or stop button located within a cavity of the concave shape may be used to activate and/or deactivate the engine. In some embodiments, this may be in addition, to or instead of, placing the boat in gear to reactivate the engine. In some embodiments, reactivation may involve a delay and/or an alarm, for example, to provide a short time and or notice to an unaware person that the engine is about to be reactivated and/or the boat is about to move. In some embodiments, one or more of these additional user interface features may be implemented such that an operator may be required to perform an additional action to reactivate the engine, thereby ensuring that the resulting movement of the boat is safe, controlled, expected, intentional, and/or the like.

Referring to FIG. 1, in some embodiments, the power unit 100 may continue to circulate water and/or coolant through the engine 102, for example, to maintain the operating temperature of the engine while the engine is deactivated. This may be implemented, for example, using an electric rather than mechanical fluid pump. In some embodiments, the power unit 100 may continue to circulate hydraulic fluid, for example, using an electrohydraulic rather than mechanical pump, to continue to provide power steering or other functionality while the engine is deactivated. In some embodiments, the power unit 100 may continue to provide electric power some or all boat accessories, e.g., without interruption while the engine is deactivated.

In some embodiments, the power unit 100 may be implemented with a hybrid electric system that may be configured to enable the boat to maneuver under electric power exclusively and/or in combination with combustion propulsion. For example, a hybrid electric propulsion system may augment the power provided by an internal combustion engine. In such an implementation, combustion hours and/or electric hours may be measured separately and/or collectively.

In some embodiments, the power unit 100 may be implemented with an engine having one or more of the following features: modifications to the crankshaft main bearing to function properly with intermittent and/or limited lubrication; enhanced battery capacity so accessories may function properly with engine off; an enhanced starter that is reinforced and designed to withstand very frequent use without wearing too fast or overheating; one or more sensors, software and/or electronic control units to implement one or more of the disclose features; a higher voltage electrical system.

The embodiments disclosed herein may be described in the context of various implementation details, but the principles of this disclosure are not limited to these or any other specific details. Some functionality has been described as being implemented by certain components, but in other embodiments, the functionality may be distributed between different systems and components in different locations and having various user interfaces. Certain embodiments have been described as having specific components, processes, steps, combinations thereof, and/or the like, but these terms may also encompass embodiments in which a specific process, step, combinations thereof, and/or the like may be implemented with multiple components, processes, steps, combinations thereof, and/or the like, or in which multiple processes, steps, combinations thereof, and/or the like may be integrated into a single process, step, combinations thereof, and/or the like. A reference to a component or element may refer to only a portion of the component or element. The use of terms such as "first" and "second" in this disclosure and the claims may only be for purposes of distinguishing the things they modify and may not indicate any spatial or temporal order. A reference to a first thing may not imply the existence of a second thing. The term "based on" may refer to "based, at least in part, on" such that a first element that is based on a second element may not be based entirely on the second element and/or may also be based at least in part on one or more additional (e.g., third) elements. The various details and embodiments described above may be combined to produce additional embodiments according to the inventive principles of this patent disclosure.

Since the inventive principles of this patent disclosure can be modified in arrangement and detail without departing from the inventive concepts, such changes and modifications are considered to fall within the scope of the following claims.

The invention claimed is:

1. A marine power system comprising:

an engine arranged to provide mechanical output power for a boat; and a controller coupled to the engine, the controller configured to:

determine an idle condition of the boat;

deactivate the engine based, at least in part, on the idle condition;

determine a demand for the mechanical output power for the boat; and activate, using an auxiliary power source, the engine based, at least in part, on the demand.

2. The marine power system of claim 1, wherein the controller is configured to determine the demand based, at least in part, on a throttle control for the boat.

3. The marine power system of claim 2, wherein the controller is configured to determine the demand based, at least in part, on a position of a mechanical component of the throttle control.

4. The marine power system of claim 2, wherein the controller is configured to determine the demand based, at least in part, on a sensor on the throttle control.

5. The marine power system of claim 2, wherein the controller is configured to activate the engine based, at least in part, on an interlock scheme.

6. The marine power system of claim 5, wherein the interlock scheme comprises a second control.

7. The marine power system of claim 6, wherein the second control comprises a switch.

8. The marine power system of claim 1, wherein the demand is a first demand, and the controller is configured to:

operate the engine at a first power level based, at least in part, on the first demand;

determine a second demand for the mechanical output power; and operate the engine at a second power level based, at least in part, on the second demand.

9. The marine power system of claim 8, wherein the controller is configured to generate the second demand based, at least in part, on an interlock scheme.

10. The marine power system of claim 1, wherein the controller is configured to determine the idle condition of the boat based, at least in part, on a throttle control for the boat.

11. The marine power system of claim 10, wherein the controller is configured to determine the idle condition of the boat based, at least in part, on a position of a mechanical component of the throttle control for the boat.

12. The marine power system of claim 11, wherein the controller is configured to activate an indicator based, at least in part, on the idle condition.

13. The marine power system of claim 12, wherein the indicator is arranged to be sensed by an occupant of the boat.

14. The marine power system of claim 12, wherein the indicator is arranged to be sensed by a person outside the boat.

15. The marine power system of claim 1, wherein the controller is configured to maintain a state of the engine based, at least in part, on the idle condition.

16. The marine power system of claim 15, wherein the state of the engine comprises a temperature of the engine.

17. The marine power system of claim 1, wherein the auxiliary power source comprises an electric power source.

18. A marine control system, the control system comprising:

a controller;

one or more connections for one or more control inputs; and one or more connections for an engine;

wherein the controller is configured to:

determine an idle condition of a boat based, at least in part on at least one of the one or more control inputs;

deactivate the engine based, at least in part, on the idle condition;

determine a demand for the mechanical output power for the boat based, at least in part, on at least one of the one or more control inputs; and activate the engine using at least one of the one or more connections for the engine based, at least in part, on the demand.

19. The marine control system of claim 18, further comprising one or more connections for an indication.

20. A method comprising:

providing, by an engine, mechanical output power for a boat;

determining an idle condition of the boat;

disabling the engine based, at least in part, on the idle condition;

determining a demand for the mechanical output power for the boat; and enabling, using an auxiliary power source, the engine based, at least in part, on the demand.

* * * * *